United States Patent [19]

Hart

[11] 3,967,843

[45] July 6, 1976

[54] WINDOW LOCK

[76] Inventor: Frank M. Hart, 740 Clayton St., Denver, Colo. 80206

[22] Filed: Nov. 22, 1974

[21] Appl. No.: 526,090

[52] U.S. Cl. ..... 292/273

[51] Int. Cl.[2] ..... E05C 17/30

[58] Field of Search..... 292/57, 305, DIG. 47, 292/266, 262, 338

[56] References Cited

UNITED STATES PATENTS

| | | | |
|---|---|---|---|
| 1,601,524 | 9/1926 | Gibbons | 292/305 |
| 1,718,995 | 7/1929 | Barnard | 292/57 X |
| 2,724,609 | 11/1955 | Donnelly | 292/266 |
| 3,471,189 | 10/1969 | Ness | 292/266 |

*Primary Examiner*—Richard E. Moore
*Attorney, Agent, or Firm*—C. B. Messenger

[57] ABSTRACT

A window lock for double-hung windows utilizing extension elements joined to each separate window and telescopically mated one with the other with a latch assembly on one element and longitudinally spaced catches on the other element whereby the windows are held in closed or in alternate relative positions providing varied window openings. Mountings facilitate installation and provide for out-of-way pivotted storage. The latch may be retained in a retracted position to facilitate adjusting movements of the windows and telescoping elements.

1 Claim, 4 Drawing Figures

WINDOW LOCK

BACKGROUND OF THE INVENTION

The double-hung type of windows that have been used for many years present a special security problem if the windows are to be left partially open for ventilation purposes. Most of the lock systems initially or previously provided for windows of the foregoing type are now inoperative by reason of long continued use or misuse, or such lock systems were never adequate to prevent unwanted intrusions if the windows were not completely closed and locked. While it is acknowledged that some previous lock attachments have been provided to hold one or both sashes of a double-hung window in closed or open positions, such previous locking devices have usually been operatively positioned between a window sash and the window frame. With such devices installation is relatively complicated.

SUMMARY OF THE INVENTION

The present invention provides a window lock system that can be easily installed at positions operatively intermediate the separate window sashes of a double-hung window. The positions for such sashes may be changed one with respect to the other as necessary to provide top and/or bottom ventilation openings as desired. The size of the ventilation openings can be adjusted. If the total size of the ventilation openings is closely regulated, the window sashes can still be conjointly moved with respect to the window frame without providing an opening through which an intruder could pass. If larger openings are desired, an additional lock mechanism that is operatively intermediate one window sash and its frame will be used so that neither window sash can be moved.

DESCRIPTION OF THE PREFERRED EMBODIMENTS

Figure 1:
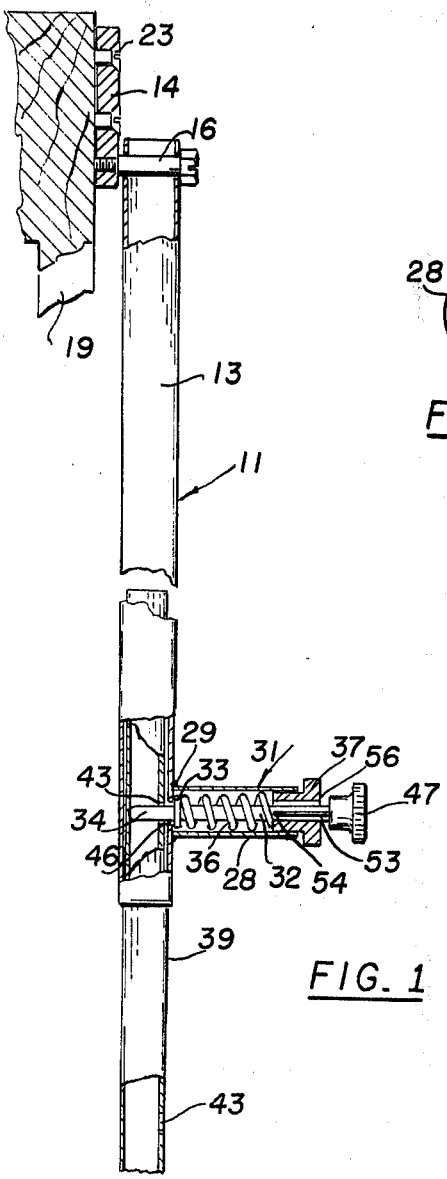
FIG. 1 is a broken side elevation in partial section showing an embodiment of the invention.
Figure 4:
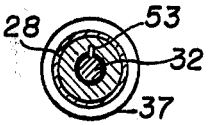
FIG. 4 is a cross-sectional elevation taken along the line 4—4 of FIG. 1.

Embodiments of the present invention provide an extension device that may be joined to window components that are movable one with respect to the other so that the windows can be held in closed position or in adjusted open positions as desired.

The window lock 11 of the present embodiment is made up of two telescoping elements of such size, contour and design that a lower, first or inner telescoping element 12 may be engaged within and moved reciprocally with respect to the upper, second or outer telescoping element 13. While the elements 12 and 13 are formed of hollow rectangular tubing, other structural shapes may be used for such components so long as at least one element is hollow to telescopically receive the other. The upper element 13 is joined to an anchor plate 14 by a shoulder screw 16, while the lower element 12 is joined to a pivot plate 17 by a pivot bolt 18. The anchor plate 14 and, accordingly, the associated upper element 13 is secured to a top rail or the side stile

19 of an upper sash or window 20, while the lower pivot plate 17 is secured to the top of the meeting rail 21 of the lower window 22.

Anchor plate 14 has a plurality of holes for the reception of the fastener screws 23, while the lower pivot plate 17 provides similar holes adapted to receive the screw fasteners 24. The lower pivot plate itself has forked upwardly opening extensions 26 that are spaced apart a distance corresponding to the size of the lower element 12, and the end 27 of such lower element is terminated a sufficient distance above the body of the plate 17 so that the lower element 12 can actually be pivotted a full 180° with respect to the plate 17. The shoulder screw 16 and the pivot bolt 18 are preferably provided with cross slots as shown, so that a screw driver is the only tool necessary for placement and installation of the window lock 11.

The upper telescoping element 13 provides support for a latch assembly 31 that is joined, as by the welds 29, to the body of upper element 13. Latch assembly 31 includes a support barrel 28 extending outwardly from the element 13, and it has an open central bore. The shaft of a latch plunger 32 extends through said bore, and a stop collar 33 is disposed adjacent the lock point 34 of plunger 32. A spring 36 is disposed within the barrel 28 for operative extension between the collar 33 and a closure plug 37. The spring urges the stop collar 33 and the lock point 34 inwardly against the exterior surface 39 of the lower element 12.

A plurality of latch receiving holes or catches 43 are disposed along the length of element 12 in spaced positions as indicated. In FIG. 1 the lock point 34 of the plunger 32 is shown to be extended through one catch opening 43 punched in the surface of the element 12. A corresponding opening 46 in the exterior surface of the upper element 13 passes the lock point 34 but restrains the collar 33. The plunger 32 has a knurled knob 47 that may be engaged by any user to retract the latch plunger and its locking point. When the plunger is retracted, the lower element 12 may be moved to adjusted telescoped positions with respect to the upper element 13. At properly adjusted positions the lock point 34 can again be disposed through one of the catch holes 43. Since the spring 36 is biased to move the locking point 34 toward engagement with the lower element 12, the lock point 34 or latch will be engaged through any of the catch holes 43. Further, since the catches 43 are disposed apart on a regulated schedule, one window 20 may be moved to various adjusted positions with respect to its companion window 22, and it will be held in such position.

Figure 2:
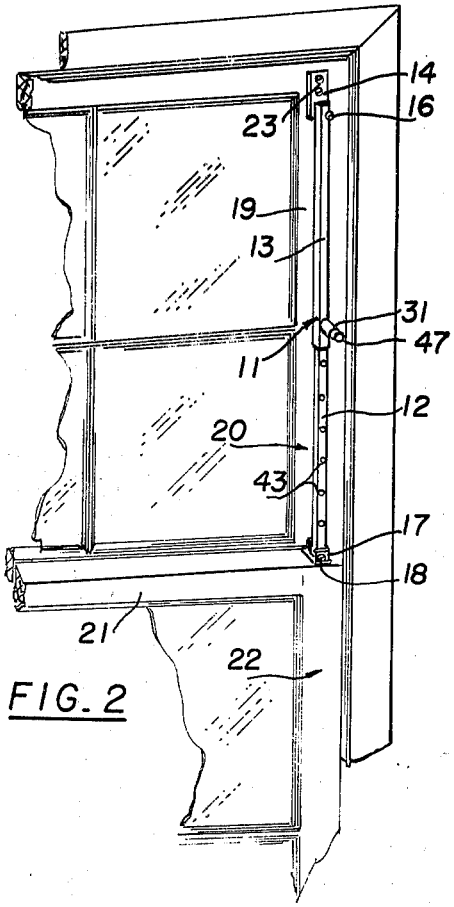
FIG. 2 is a perspective drawing showing the invention applied to a double-hung window.
Figure 3:
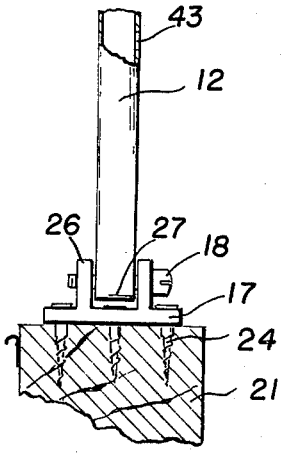
FIG. 3 is a front elevation showing the device in telescoped position.
Figure 3:
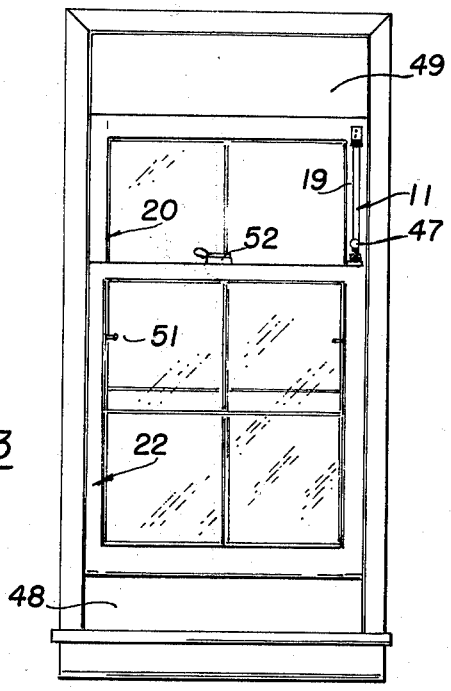

FIG. 3 is illustrative of a retracted telescoped position wherein substantially all of the lower element 12 is disposed within the upper element 13. The depicted arrangement of the windows provides air ventilation through a bottom opening 48 and also through a top opening 49. Side locks 51 initially provided in some double-hung window installations can still be used so that the windows cannot be shifted by any intruder to provide a bottom opening 48 of size that would admit such intruder. The disposition of the latch assembly 31 and of an uppermost catch hole 43 and the position of placement for the top anchor plate 14 is preferably regulated so that the latch plunger 32 will be engaged through the said uppermost catch hole 43 when the windows 20 and 22 are in the full closed position shown in FIG. 2. If this arrangement is preserved and if a sash lock 52 is installed, a doubled security is maintained.

Since it will often be desirable to move the respective windows to an adjusted position before the latch lock 31 is engaged, a key shoulder 53 is provided on the plunger 32 that extends radially from such plunger. A correspondingly enlarged key slot is provided in the closure plug 37 that will admit the key shoulder 53. With this arrangement the knob 47 and the latch may be pulled outwardly until the inner end 54 of the key shoulder 53 clears the outer face 56 of the closure plug 37. If the knob 47 is then rotated, key shoulder 53 will be engaged with the outer face 56 of closure plug 37 to keep latch point 34 in a retracted position. Once the windows are moved to their desired adjusted position, knob 47 can again be rotated so that the key shoulder is admitted through its corresponding key slot in the closure plug 37. Slight further adjusting movement of the windows will then assure engagement of the latch point through a mating opening 43.

If a larger lower or upper through opening 48 or 49 is required, the window lock 11 may be moved to an out-of-way position. As an example, if the windows are to be washed, the top shoulder screw 16 may be disengaged from the top plate 14, and the window lock 11 can then be pivotted about the lower pivot bolt 18 to a position along the intermediate meeting rail 21. The windows 20 and 22 will then be separately movable to any desired adjusted position. Since the top anchor plate 14 is of relatively thin construction, the lower window 22 can actually be moved upwardly and past the top rail of the top window if the interlocking weatherstrip usually provided on the meeting rails is cut away in position of alignment with the anchor plate 14. This type of freedom of movement is, of course, required if the outside surfaces of the upper window panes installed in the lower or inside window sash are to be washed by a person supporting himself outside a building by sitting on the window sill. After window washing activities have been completed, the window lock 11 can be pivotally moved back to its operative position, and the shoulder screw 16 can be reinstalled.

I claim:

1. A window lock for frame-mounted double-hung windows to hold the lower and upper windows in closed and in adjusted open positions one with respect to the other comprising a first elongated element secured to the lower window, a second elongated element secured to the upper window, said first and second elements being cooperatively formed and arranged whereby one element is telescopically received in the other for conjoint movement to retracted and extended positions as the windows are moved to open and closed positions, respectively, a latch assembly for said window lock mounted on one of said telescoping elements, a latch plunger for said latch assembly, a resilient member engaging said plunger and biasing the latch plunger for movement toward the other of said telescoping elements, said other telescoping element providing a plurality of catches at longitudinally spaced positions therealong for the selective reception of said latch plunger whereby the windows are selectively held in desired relative positions one with respect to the other in the frame, an anchor plate secured to said upper window, a threaded screw for engagement with said anchor plate for selectively securing the second elongated element to the upper surface of the meeting rail for said bottom window, means interconnecting the first elongated element to said pivot plate, and a pivot bolt engaging said pivot plate and the first elongated element with the axis of said bolt arranged transversely with respect to said meeting rail whereby the telescoping first and second elements may be moved pivotally about said pivot bolt to a position disposed along the meeting rail for the bottom window when the threaded screw is removed from said anchor plate.

* * * * *

UNITED STATES PATENT OFFICE

CERTIFICATE OF CORRECTION

Patent No. 3,967,843 Dated July 6, 1976

Inventor(s) Frank M. Hart

It is certified that error appears in the above-identified patent and that said Letters Patent are hereby corrected as shown below:

In claim 1, column 4, line 28, after "the", first occurrence, insert -- upper window, a pivot plate mounted on the -- .

Signed and Sealed this

Twenty-first Day of September 1976

[SEAL]

*Attest:*

RUTH C. MASON
*Attesting Officer*

C. MARSHALL DANN
*Commissioner of Patents and Trademarks*